US011291924B2

(12) United States Patent
Wang

(10) Patent No.: US 11,291,924 B2
(45) Date of Patent: Apr. 5, 2022

(54) REVERSIBLE TOY AND MANUFACTURING METHOD THEREOF

(71) Applicant: KAI SHUN INDUSTRIAL CO., LTD., Taoyuan (TW)

(72) Inventor: Dong-Mei Wang, Dongguan (CN)

(73) Assignee: KAI SHUN INDUSTRIAL CO., LTD., Taoyuan (TW)

( * ) Notice: Subject to any disclaimer, the term of this patent is extended or adjusted under 35 U.S.C. 154(b) by 0 days.

(21) Appl. No.: 16/891,848

(22) Filed: Jun. 3, 2020

(65) Prior Publication Data

US 2021/0275934 A1 Sep. 9, 2021

(30) Foreign Application Priority Data

Mar. 5, 2020 (CN) ..... 202010146477.6

(51) Int. Cl.

| | |
|---|---|
| ***A63H 3/12*** | (2006.01) |
| ***A63H 33/00*** | (2006.01) |
| ***A63H 9/00*** | (2006.01) |
| ***A63H 3/02*** | (2006.01) |
| ***A63H 3/36*** | (2006.01) |

(52) U.S. Cl.

CPC ..... *A63H 33/003* (2013.01); *A63H 3/02* (2013.01); *A63H 3/12* (2013.01); *A63H 3/365* (2013.01); *A63H 9/00* (2013.01)

(58) Field of Classification Search

CPC ..... A63H 3/12; A63H 3/165; A63H 33/003; A63H 3/365

See application file for complete search history.

(56) References Cited

U.S. PATENT DOCUMENTS

| | | | | |
|---|---|---|---|---|
| 5,090,938 | A * | 2/1992 | Reynolds | A63H 3/12 434/133 |
| 5,328,399 | A * | 7/1994 | Reynolds | A42B 1/004 2/209.11 |
| 6,126,507 | A * | 10/2000 | Lieberman | A42B 1/004 2/209.11 |
| 6,506,094 | B1 * | 1/2003 | Chang | A63H 3/16 446/268 |
| 6,752,679 | B1 * | 6/2004 | Lui | A63H 3/005 446/321 |
| 8,550,866 | B2 * | 10/2013 | Wadhwani | A63H 3/003 446/72 |
| 9,975,053 | B1 * | 5/2018 | Sutton | A63H 3/365 |
| 10,786,746 | B2 * | 9/2020 | Badie | A63H 3/02 |

* cited by examiner

*Primary Examiner* — John A Ricci

(74) *Attorney, Agent, or Firm* — Rabin & Berdo, P.C.

(57) ABSTRACT

A reversible toy has a main body. The main body has a first configured unit and a second configured unit joined with each other. Each of the first and the second configured units is made of elastomer. One of the first and the second configured units is filled in the other one of the first and the second configured units to form a reversible opening formed in a bottom of the main body, and positions of the first and the second configured units are interchangeable via the reversible opening.

11 Claims, 9 Drawing Sheets

REVERSIBLE TOY AND MANUFACTURING METHOD THEREOF

BACKGROUND OF THE INVENTION

1. Field of the Invention

The present invention relates to a toy, and more particularly to a reversible toy which can be converted into different configurations. The present invention also relates to a manufacturing method of the reversible toy.

2. Description of Related Art

A conventional stuffed toy or a conventional rubber toy has one single configuration. Each toy only presents one character, which lacks fun. Consumers may buy multiple toys for playing, increasing the cost for purchasing toys and also raising the risk of losing the toys. The storage spaces needed for the toys will be increased. The toy having one single configuration may limit children's development and imagination and have no educational function. Having too many toys does not help children to develop habits of frugality or cherishing resources.

The conventional stuffed toy has an outer fabric sewn from plush fabrics or other textiles and filled with cottons or fibers. The conventional stuffed toy is heavy and is not easy to fold and carry. The stuffed materials of the conventional stuffed toy may breed bacteria easily and cause health and safety issues.

A conventional soft toy, which is made of plush fabrics or elastomer and can be converted into different configurations, is complex in structure, and has an opening formed in a front or a rear of a toy body of the conventional soft toy. The conventional soft toy has some aesthetic defect because the opening is visually obvious. The conventional soft toy may have a zipper, push buttons, buttons, or touch fasteners, etc. to close the opening. To assemble the above mentioned components in the toy body will increase the production steps, increase manufacturing costs, and reduce production efficiency.

To overcome the shortcomings, the present invention tends to provide a reversible toy to mitigate or obviate the aforementioned problems.

SUMMARY OF THE INVENTION

The main objective of the invention is to provide a reversible toy which may be converted into different configurations. The reversible toy is made of elastomer material, has a simple structure, and can be manufactured easily at low cost. A main body of the reversible toy has a reversible opening formed in a bottom thereof, which is not visually obvious and provides an aesthetically-appealing appearance.

The reversible toy has a main body having a first configured unit and a second configured unit joined with each other, and the first and the second configured units are made of elastomer. One of the first and the second configured units is filled in the other one of the first and the second configured units to form a reversible opening in a bottom of the main body, and positions of the first and the second configured units are interchangeable via the reversible opening.

Other objects, advantages and novel features of the invention will become more apparent from the following detailed description when taken in conjunction with the accompanying drawings.

DETAILED DESCRIPTION OF PREFERRED EMBODIMENT

Figure 1:
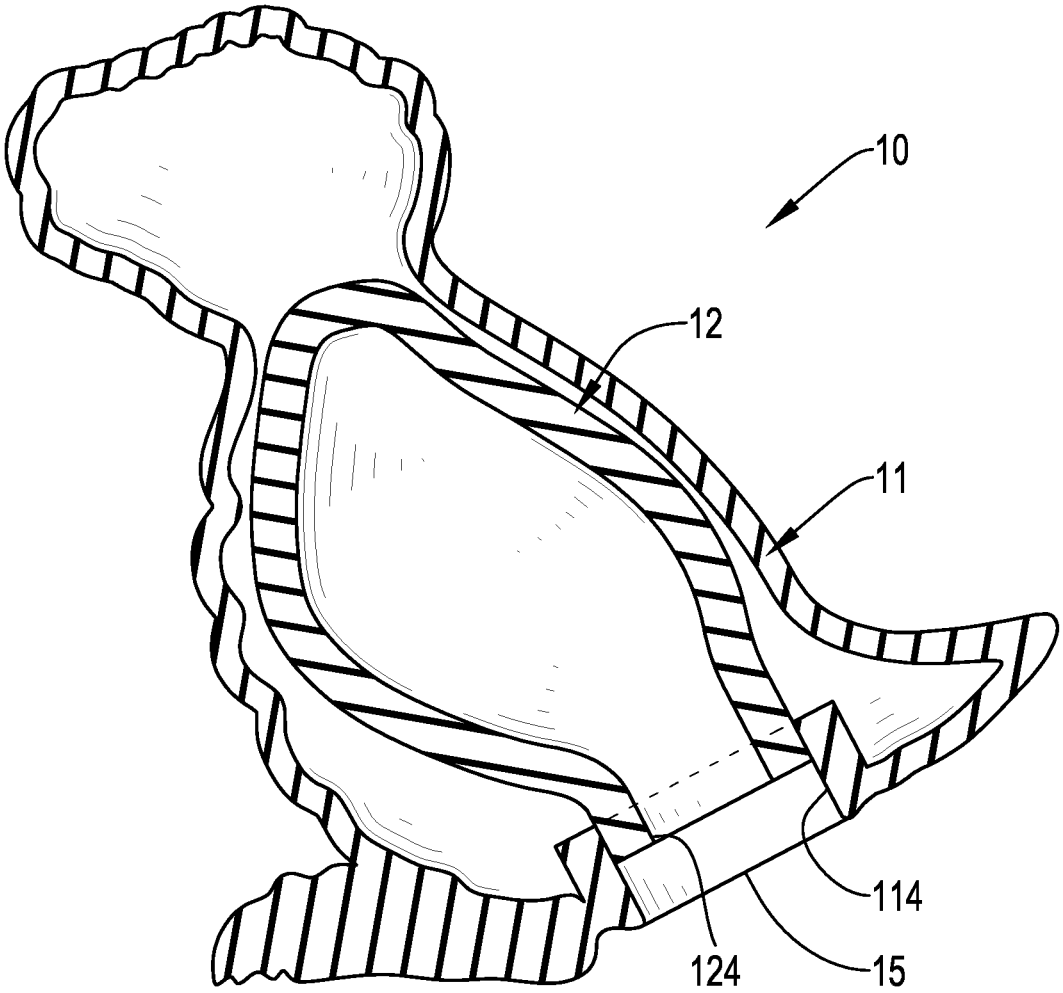
FIG. 1 is a cross sectional side view of a reversible toy in accordance with the present invention showing that a second configured unit is filled in a first configured unit of the reversible toy.
Figure 2:
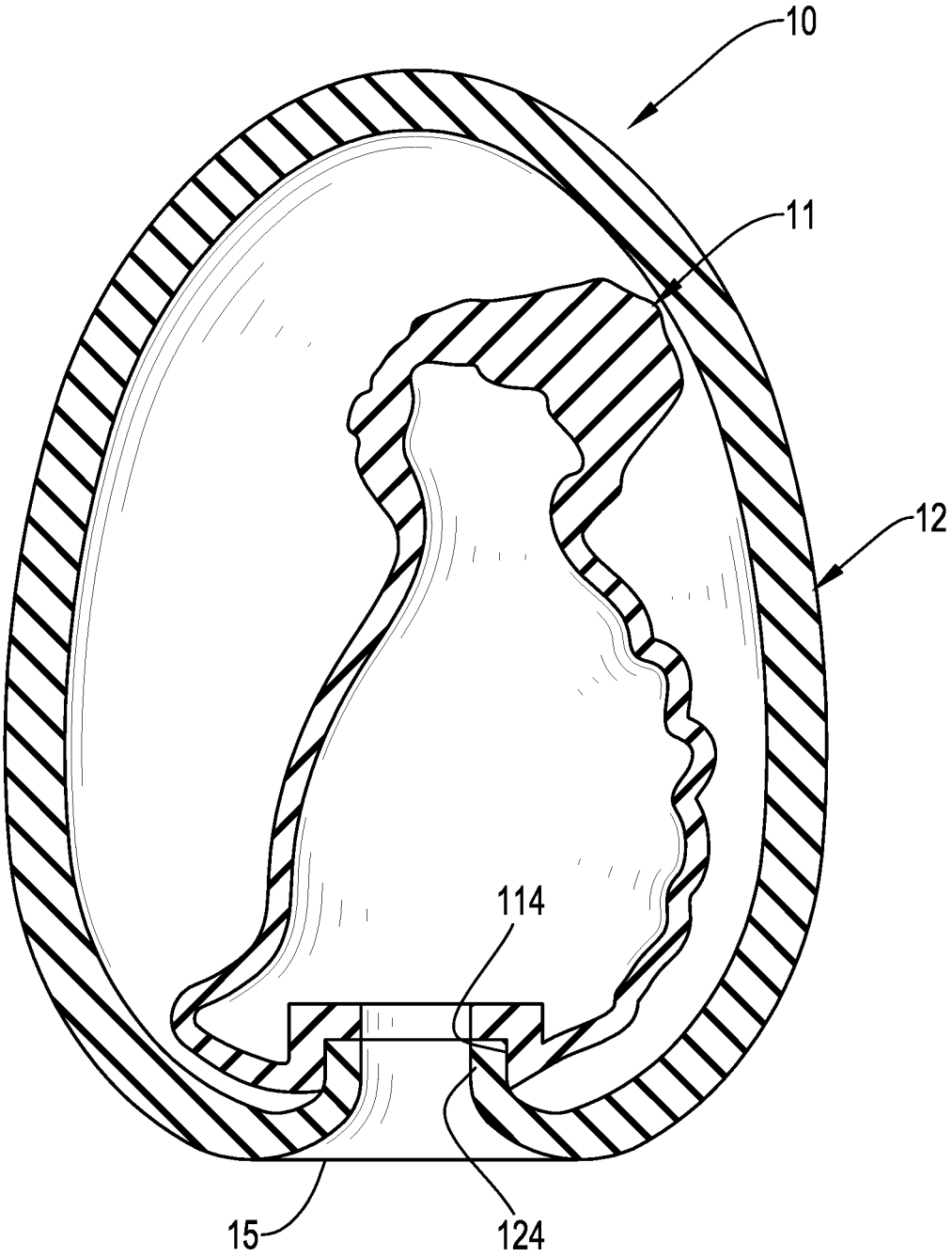
FIG. 2 is a cross sectional side view of the reversible toy in FIG. 1 showing that the first configured unit is filled in the second configured unit of the reversible toy.
Figure 3:
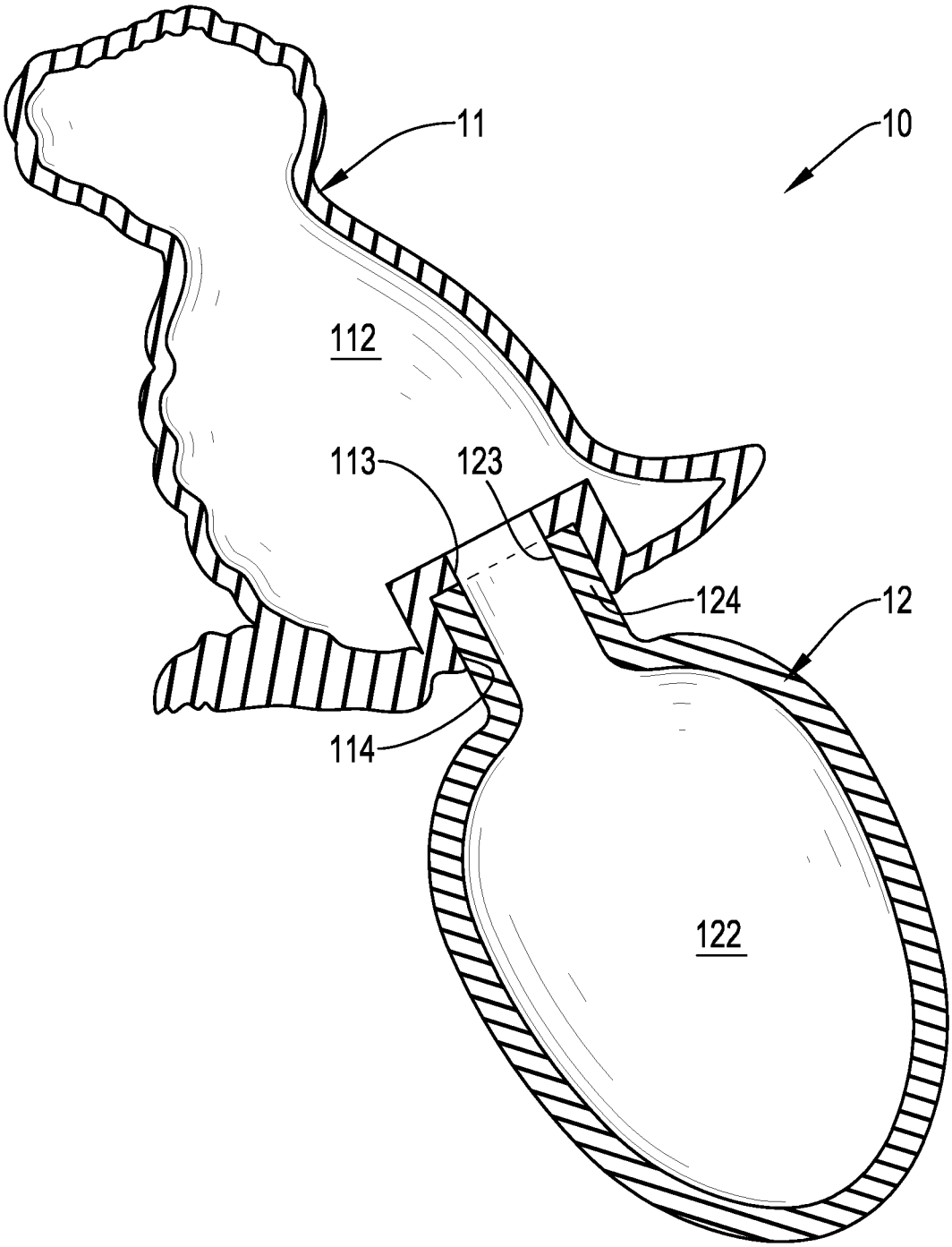
FIG. 3 is a cross sectional side view of the reversible toy in FIG. 1 showing that the first and the second configured units are bonded with each other.

With reference to FIGS. 1 to 3, a reversible toy in accordance with the present invention has a main body 10. The main body 10 has a first configured unit 11 and a second configured unit 12 joined with each other. In an embodiment, the first configured unit 11 and the second configured unit 12 are bonded with each other by adhesive. In another embodiment, the first configured unit 11 and the second configured unit 12 are joined together as an integrated body by molding.

The first configured unit 11 and the second configured unit 12 are made of elastomers. The material of each of the first and the second configured units 11, 12 is selected from one of flexible plastics (e.g., soft polyvinyl chloride, soft PVC), thermoplastic elastomers (e.g., thermoplastic rubber, TPR), silicones, and rubbers. In this embodiment, the material of each of the first and the second configured units 11, 12 is thermoplastic rubber (TPR). The thermoplastic rubber can be easily formed into a configured unit at a low manufacturing cost by molding.

The first configured unit 11 has a first cavity 112 formed therein and having a first opening 113 formed in a bottom of the first configured unit 11. The second configured unit 12 has a second cavity 122 formed therein and a second opening 123 formed in a bottom of the second configured unit 12. The first opening 113 and the second opening 123 are connected with each other via a connected portion surrounding the first opening 113 and the second opening 123 as shown in FIG. 3, and the first cavity 112 and the second cavity 122 communicate with each other. The first configured unit 11 and the second configured unit 12 are joined with each other to form the connected portion between the first and the second configured units 11, 12.

One of the first and the second configured units 11, 12 is filled in the other one of the first and the second configured units 11, 12 to form a reversible opening 15 formed in a bottom of the main body 10, and positions of the first and the second configured units 11, 12 are interchangeable via the reversible opening 15. The reversible opening 15 is formed in the connected portion between the first and the second configured units 11, 12. After one of the first and the second configured units 11, 12 is filled into the other one of the first and the second configured units 11, 12, the reversible opening 15 is formed in the bottom of the main body 10.

For example, when the second configured unit 12 is filled in the first configured unit 11, the first configured unit 11 forms the outer configuration of the main body 10, the second configured unit 12 forms a filled body of the main body 10, and the reversible opening 15 is formed in the bottom of the main body 10 in a position where the second configured unit 12 is connected with the first configured unit 11. The second configured unit 12 can be pulled out from the first configured unit 11 via the reversible opening 15. After that, the first configured unit 11 can be inserted into the second configured unit 12 to convert the outer configuration of the main body 10 from the first configured unit 11 into the second configured unit 12. The playability of the reversible toy of the present invention is improved.

Because the reversible opening 15 is formed in the bottom of the main body 10, the reversible opening 15 is not easily visible when placed, and the reversible toy of the present invention can have a good aesthetic appeal. The reversible toy is made of elastomer, which is flexible and elastic to provide a comfortable tactile feel. Since the first and the second configured units 11, 12 are made of elastomer, the reversible toy has a simple structure, and can be easily manufactured at low manufacturing costs.

With reference to FIGS. 4 to 8, each of the first configured unit 11 and the second configured unit 12 may be shaped as an animal, a plant, an alphabet, a numeral, and so on.

Figure 7:
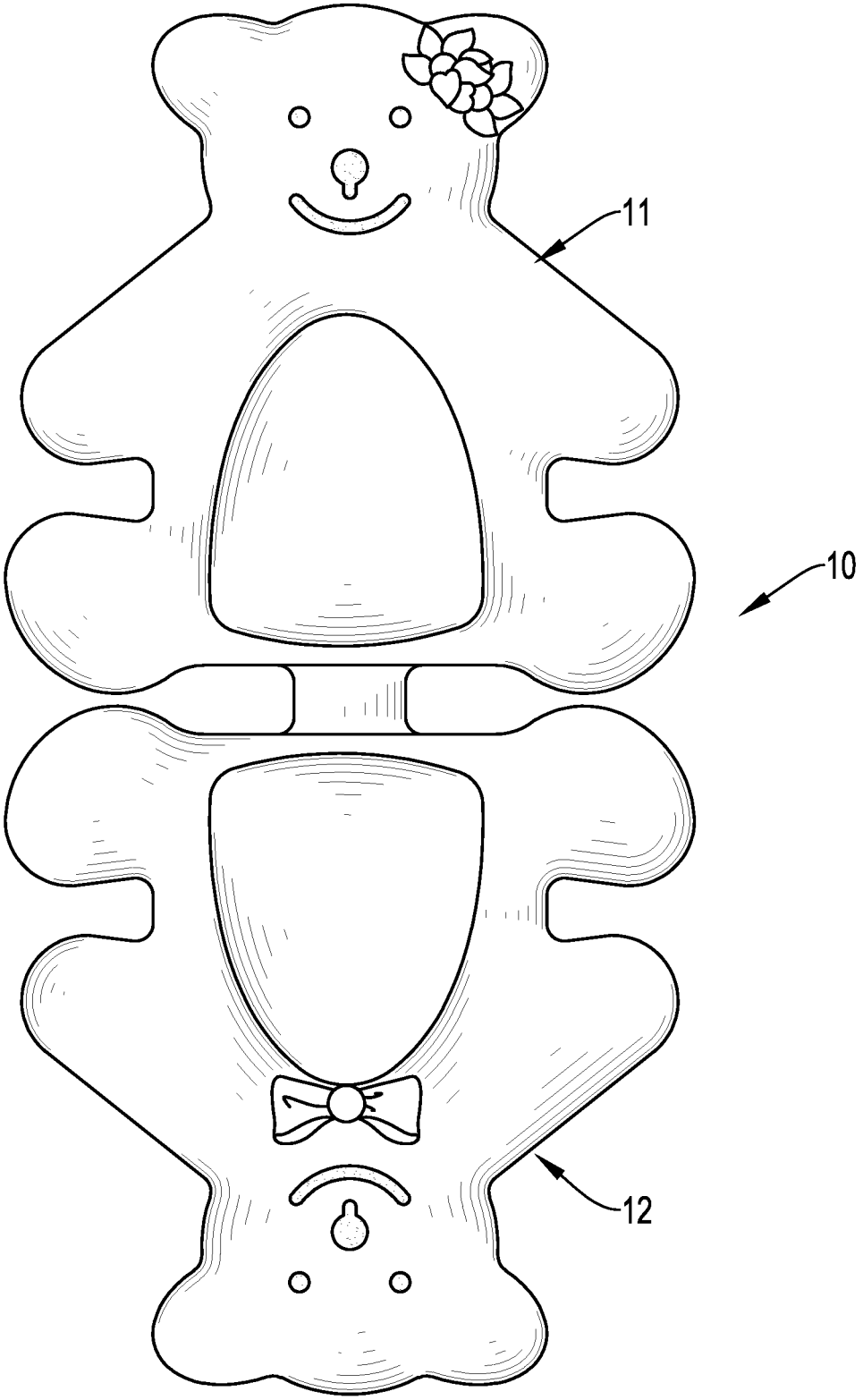
FIG. 7 is a side view of the reversible toy in accordance with the present invention showing that the first and the second configured units are in the same shape.

The first configured unit 11 is in the same shape as the second configured unit 12, such as FIG. 7, and the first configured unit 11 and the second configured unit 12 may have different colors or different decorations.

Figure 4:
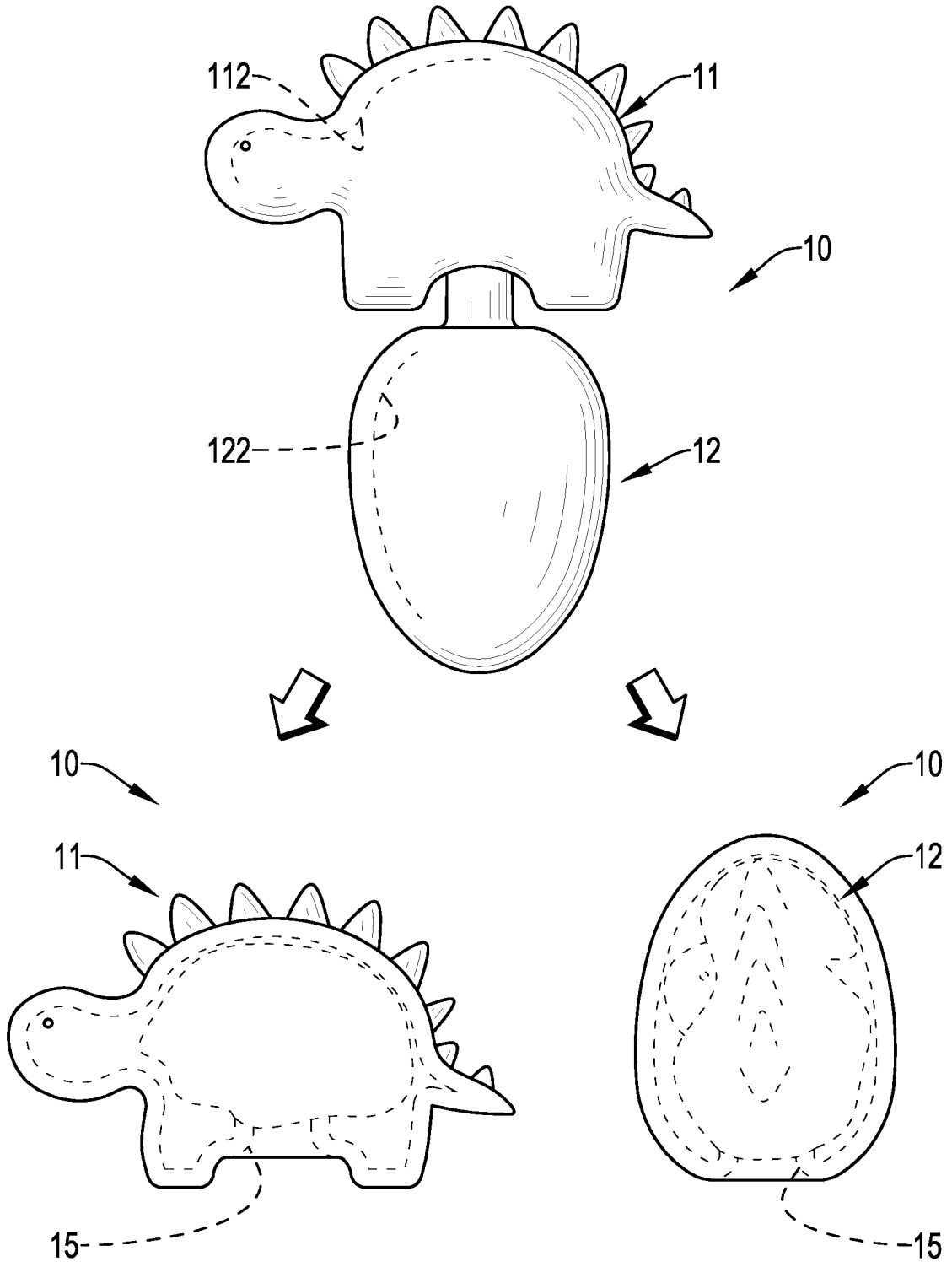
FIG. 4 is an operational side view of the reversible toy in accordance with the present invention showing that the reversible toy is converted into the first configured unit or the second configured unit.
Figure 5:
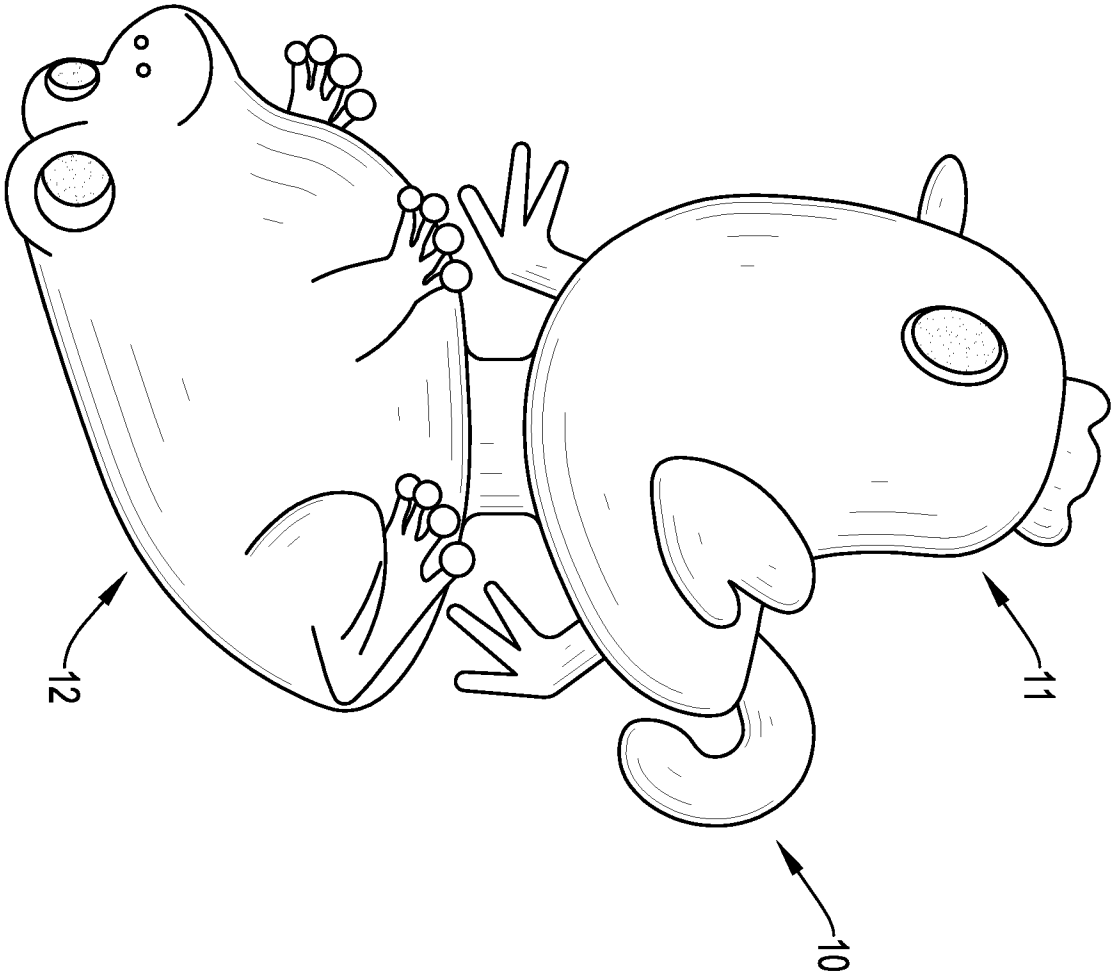
FIG. 5 is a side view of the reversible toy in accordance with the present invention showing that the first and the second configured units are in the shapes of different animals.
Figure 6:
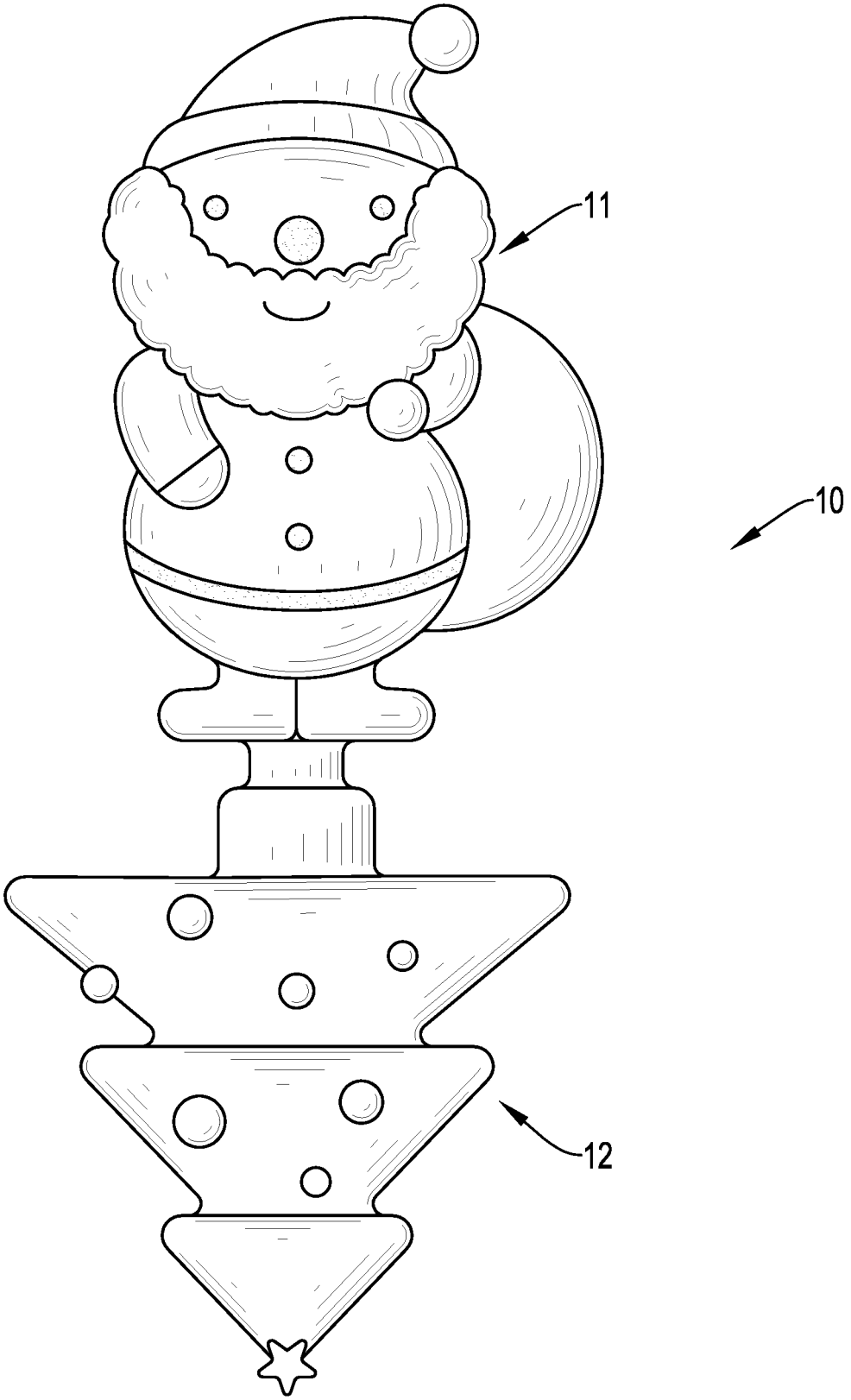
FIG. 6 is a side view of the reversible toy in accordance with the present invention showing that the first configured unit is in the shape of a Santa Claus, and the second configured unit is in the shape of a Christmas tree.
Figure 8:
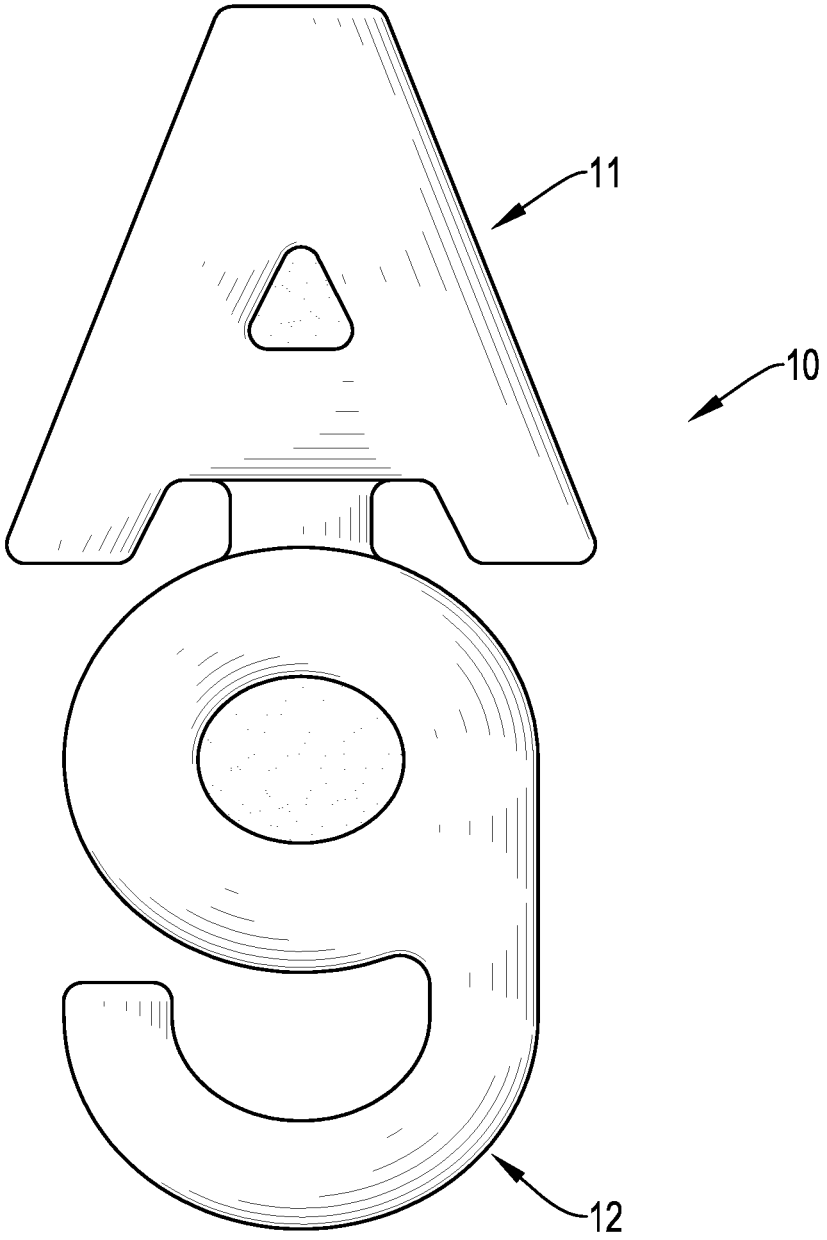
FIG. 8 is a side view of the reversible toy in accordance with the present invention showing that the first configured unit is in the shape of an alphabet, and the second configured unit is in the shape of a numeral.
Figure 9A:
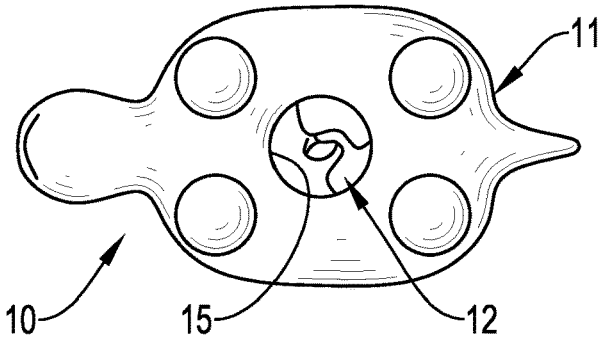
FIGS. 9A to 9D are bottom views of the reversible toy in FIG. 4 showing different shapes of the reversible opening of the reversible toy.
Figure 9B:
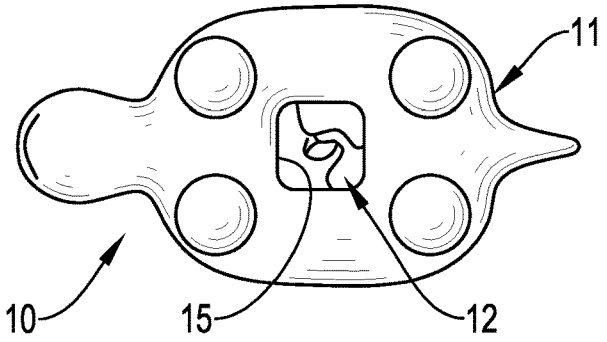
Figure 9C:
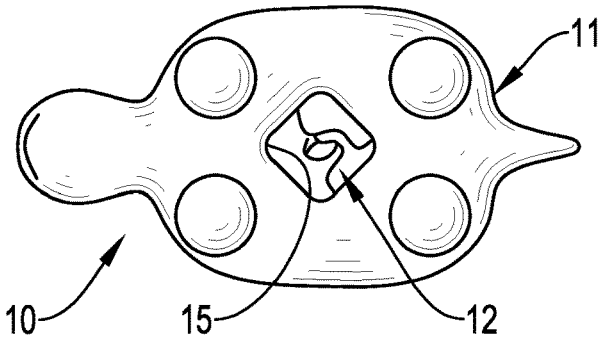
Figure 9D:
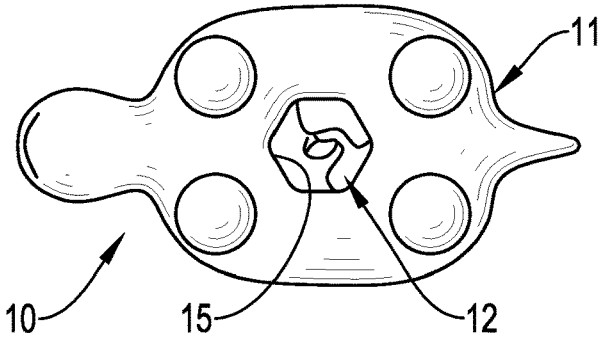

The first and the second configured units 11, 12 may be made in different configurations. With reference to FIG. 4, the first configured unit 11 is configured as a dinosaur, and the second configured unit 12 is configured as a dinosaur egg. With reference to FIG. 5, the first and the second configured units 11, 12 are shaped into different animals. With reference to FIG. 6, the first configured unit 11 is configured as a Santa Claus, and the second configured unit 12 is configured as a Christmas tree. With reference to FIG. 8, the first configured unit 11 is shaped as an alphabet, and the second configured unit 12 is shaped as a numeral.

With reference to FIGS. 1 to 3, the first configured unit 11 has a recess 114 recessed in the bottom thereof, and the second configured unit 12 has a protrusion 124 protruding from the bottom thereof. The protrusion 124 of the second configured unit 12 is mounted in and bonded to the recess 114 of the first configured unit 11 to form the connected portion between the first and the second configured units 11, 12. The first configured unit 11 and the second configured unit 12 can be assembled and joined easily via the recess 114 and the protrusion 124.

With reference to FIGS. 9A to 9D, a shape of the reversible opening 15 may be circular, rectangular, rhombus, polygonal, and so on.

A manufacturing method of the reversible toy comprises steps as follows:

Step 1: a first configured unit 11 made of elastomer and a second configured unit 12 made of elastomer are respectively formed by molding. The first and the second configured units 11, 12 may be made of TPR and are respectively formed by injection molding. The first configured unit 11 has a first cavity 112 formed therein and having a first opening 113 formed in a bottom of the first configured unit 11. The first configured unit 11 has a recess 114 recessed in the bottom thereof, and the first opening 113 is formed in the recess 114. The second configured unit 12 has a second cavity 122 formed therein and having a second opening 123 formed in a bottom of the second configured unit 12. The second configured unit 12 has a protrusion 124 protruding from the bottom thereof, and the second opening 123 is formed in the protrusion 124.

Step 2: with reference to FIG. 3, the first and the second configured units 11, 12 are bonded with each other by adhesive. The protrusion 124 of the second configured unit 12 is mounted in and bonded with the recess 114 of the first configured unit 11 to form a connected portion between the first and the second configured units 11, 12, and the first cavity 112 and the second cavity 122 communicate with each other.

Step 3: with reference to FIG. 4, one of the first and the second configured units 11, 12 is inserted into the other one of the first and the second configured units 11, 12.

In another embodiment of a manufacturing method of the reversible toy, the main body 10 has a first configured unit 11 and a second configured unit 12 joined with each other and formed integrally by molding. The first configured unit 11 and the second configured unit 12 are connected with each other with a connected portion formed between the bottoms of the first configured unit 11 and the second configured unit 12. The first configured unit 11 has a recess 114 recessed in the bottom thereof, and the second configured unit 12 has a protrusion 124 on the bottom thereof and connected with the recess 114 of the first configured unit 11 to form the connected portion between the first configured unit 11 and the second configured unit 12. A gap is formed between the recess 114 and the protrusion 124 for mold releasing.

In the above-mentioned embodiment, the manufacturing method of the reversible toy comprises steps as follows:

Step 1: forming a main body 10 made of elastomer having a first configured unit 11 and a second configured unit 12 connected with each other by molding. Wherein, a recess 114 is formed in a bottom of the first configured unit 11, a protrusion 124 is formed on a bottom of the second configured unit 12, and the recess 114 and the protrusion 124 are joined with each other to form a connected portion between the first configured unit 11 and the second configured unit 12.

Step 2: inserting one of the first and the second configured units 11, 12 into the other.

What is claimed is:

1. A reversible toy comprising:

a main body having a first configured unit and a second configured unit joined with each other, and the first and the second configured units made of elastomer;

wherein one of the first and the second configured units is filled in the other one of the first and the second configured units to form a reversible opening in a bottom of the main body, and positions of the first and the second configured units are interchangeable via the reversible opening; and wherein the first configured unit has a recess recessed in a bottom of the first configured unit, and the second configured unit has a protrusion protruding from a bottom of the second configured unit and mounted in and bonded to the recess of the first configured unit.

2. The reversible toy as claimed in claim 1, wherein a material of each of the first and the second configured units is selected from one of thermoplastic elastomers, silicones, and rubbers.

3. The reversible toy as claimed in claim 1, wherein a material of each of the first and the second configured units is thermoplastic rubber.

4. The reversible toy as claimed in claim 1, wherein a shape of each one of the first and the second configured units is selected from an animal, a plant, an alphabet, and a numeral.

5. The reversible toy as claimed in claim 1, wherein the first configured unit and the second configured unit are in the same shape.

6. The reversible toy as claimed in claim 1, wherein the first and the second configured units are in different shapes.

7. The reversible toy as claimed in claim 1, wherein a shape of the reversible opening is selected from one of circular, rectangular, rhombus, and polygonal.

8. A manufacturing method of a reversible toy comprising steps as follows:

respectively forming a first configured unit made of elastomer and a second configured unit made of elastomer by molding;

bonding the first and the second configured units with each other, wherein the first configured unit has a recess formed in a bottom of the first configured unit, and the second configured unit has a protrusion protruding from a bottom of the second configured unit and mounted in and bonded with the recess of the first configured unit; and inserting one of the first and the second configured units into the other one of the first and the second configured units.

9. The manufacturing method of a reversible toy as claimed in claim 8, wherein a material of each of the first and the second configured units is thermoplastic rubber.

10. A manufacturing method of a reversible toy comprising steps as follows:

forming a main body made of elastomer having a first configured unit and a second configured unit connected with each other by molding, wherein a recess is formed in a bottom of the first configured unit, a protrusion is formed on a bottom of the second configured unit, and the recess and the protrusion are joined with each other to form a connected portion between the first configured unit and the second configured unit; and inserting one of the first and the second configured units into the other one of the first and second configured units.

11. The manufacturing method of a reversible toy as claimed in claim 10, wherein a material of each of the first and the second configured units is thermoplastic rubber.

* * * * *